US005255777A

United States Patent [19]

Pawelko

[11] Patent Number: 5,255,777

[45] Date of Patent: Oct. 26, 1993

[54] APPARATUS FOR TRANSPORTING GROUPS OF ROD-SHAPED ARTICLES OF THE TOBACCO PROCESSING INDUSTRY

[75] Inventor: Karl-Heinz Pawelko, Marschacht, Fed. Rep. of Germany

[73] Assignee: Korber AG, Hamburg, Fed. Rep. of Germany

[21] Appl. No.: 938,794

[22] Filed: Sep. 1, 1992

[30] Foreign Application Priority Data

Sep. 6, 1991 [DE] Fed. Rep. of Germany ..... 4129672

[51] Int. Cl.[5] ..... B65G 29/00

[52] U.S. Cl. ..... 198/471.1; 198/450; 198/476.1

[58] Field of Search ..... 198/432, 433, 450, 471.1, 198/475.1, 476.1

[56] References Cited

U.S. PATENT DOCUMENTS

| | | | |
|---|---|---|---|
| 3,039,587 | 6/1962 | Pollmann | 198/476.1 |
| 4,051,947 | 10/1977 | Schumacher | 198/478 |
| 4,506,779 | 3/1985 | Seragnoli | 198/471.1 X |
| 4,645,063 | 2/1987 | Seragnoli | 198/450 |
| 4,804,079 | 2/1989 | Hensgen | 198/450 |
| 4,827,948 | 5/1989 | Schumacher | 198/471.1 X |

FOREIGN PATENT DOCUMENTS 2217574 11/1989 United Kingdom .

*Primary Examiner*—James R. Bidwell
*Attorney, Agent, or Firm*—Darby & Darby

[57] ABSTRACT

Apparatus for converting two parallel files of coaxial cigarettes into a single row of parallel pairs of coaxial cigarettes has a guide which delivers the two files of cigarettes from a twin cigarette maker and a first rotary conveyor with arms for pairs of flutes each of which removes a pair of coaxial cigarettes at a first transfer station. The pairs of cigarettes are transported, without a change of orientation, to a second transfer station between the first rotary conveyor and a second rotary conveyor. The latter has a first set of flutes at its peripheral surface and a second set of flutes on pivotable levers which can pivot the flutes of the second set away from and back toward the peripheral surface of the second conveyor. One flute of each pair of flutes on the first conveyor delivers a pair of cigarettes directly into a flute of the first set, and the other flute of each pair of flutes on the first conveyor delivers a pair of cigarettes into a flute of the second set. The flute of the second set is then pivoted toward the peripheral surface of the second conveyor and comes to rest between two flutes of the first set. The first conveyor transports pairs of cigarettes in a vertical plane.

19 Claims, 4 Drawing Sheets

APPARATUS FOR TRANSPORTING GROUPS OF ROD-SHAPED ARTICLES OF THE TOBACCO PROCESSING INDUSTRY

BACKGROUND OF THE INVENTION

The invention relates to improvements in apparatus for transporting groups of plain or filter cigarettes or other rod-shaped articles of the tobacco processing industry. More particularly, the invention relates to improvements in apparatus for transporting rod-shaped articles from one or more first paths, along endless additional paths and into a further path, e.g., into or in a filter tipping machine for cigarettes, cigarillos or cigars.

Commonly owned U.S. Pat. No. 4,804,079 to Hensgen et al. (granted Feb. 14, 1989) discloses an apparatus wherein two files of coaxial rod-shaped articles of the tobacco processing industry are conveyed along two parallel paths which are located in a common vertical plane. A first conveyor has arms mounted for orbital movement along a circular path which is located in a vertical plane, and the arms carry pairs of receptacles which are disposed above each other and are maintained in parallelism with the articles of the two files. The pairs of receptacles accept articles from the two files and deliver the articles into the range of a second conveyor having flutes for parallel articles. The speed of the articles is reduced during travel with the first conveyor toward the transfer station between the first and second conveyors, and the direction of movement of the articles changes from combined axial and sidewise movement with the first conveyor to a purely sidewise or transversal movement with the second conveyor. The apparatus of Hensgen et al. can be utilized to transport plain cigarettes between the outlet of a twin cigarette rod making machine and the inlet of a filter tipping machine.

OBJECTS OF THE INVENTION

An object of the invention is to provide an apparatus which constitutes an improvement over and a further development of the apparatus disclosed in the aforediscussed patent to Hensgen et al.

Another object of the invention is to provide a novel and improved second conveyor for use in the improved apparatus.

A further object of the invention is to provide a novel and improved combination of conveyors for use in connection with the transport of plain cigarettes or other rod-shaped articles of the tobacco processing industry between a maker and a processing machine.

An additional object of the invention is to provide a novel and improved method of manipulating pairs of parallel rod-shaped articles of the tobacco processing industry between a maker of two tobacco rods and a filter tipping or other processing machine for rod-shaped articles of the tobacco processing industry.

SUMMARY OF THE INVENTION

The invention resides in the provision of an apparatus for transporting rod-shaped articles of the tobacco processing industry. The improved apparatus comprises means for supplying first and second files of coaxial articles along parallel first and second paths, a first conveyor having at least one circulating device including means for removing articles from the files and for conveying the removed articles along a third path, and a second conveyor having means for accepting the articles from the removing means and for moving the accepted articles sideways along a fourth path. The second conveyor further comprises means for moving the accepting means from the fourth path toward the third path to accept articles from the removing means and thereupon back to the fourth path.

The second conveyor preferably comprises a rotor, such as a rotary drum-shaped support, for the accepting means and the moving means. The peripheral surface of the rotor defines the fourth path.

The second conveyor further comprises at least one article accepting device at the peripheral surface of the rotor, and the removing means includes a first receptacle for articles of the first file and a second receptacle for articles of the second file. The accepting device includes means for receiving articles of the first file from the first receptacles, and the accepting means includes means for receiving articles of the second file from the second receptacle. The arrangement is preferably such that the first conveyor comprises a plurality of circulating devices each having discrete removing means with first and second receptacles, and the second conveyor comprises a plurality of accepting devices for articles of the first file, discrete accepting means for each accepting device, and discrete moving means for each accepting means. Each moving means can comprise a lever which is pivotably mounted on the rotor and has a follower tracking a cam which controls the movements of the respective accepting means between the third and fourth paths. The axis of rotation of the rotor is preferably parallel to the pivot axes of the levers, and the accepting devices of the second conveyor are parallel to such axes. The accepting devices are preferably equidistant from each other, as seen in the circumferential direction of the rotor, and the accepting means are preferably equidistant from each other and from the accepting devices upon movement of the accepting means back to the fourth path.

The apparatus further comprises a third conveyor having means (e.g., parallel flutes) for receiving articles from the second conveyor.

The first conveyor preferably further comprises means for maintaining the article removing means in parallelism with the articles in the first and second paths. The first and second paths are preferably disposed in a horizontal plane, and the third path is preferably located in a substantially vertical plane, for example, above the plane or planes of the first and second paths.

The third path is preferably a substantially elliptical path having a major axis parallel to the first and second paths and a minor axis normal to the major axis. The supplying means includes means for advancing articles along the first and second paths at a first speed, and the third path is preferably positioned to enable the removing means to remove articles from the first and second paths at the minor axis of the elliptical third path and at least substantially at the first speed, and to reduce the (first) speed of removed articles to a second speed (e.g., zero or close to zero) during movement along the third path toward a transfer station between the third and fourth paths. Such transfer station is or can be disposed at the major axis.

The supplying means can include means for supplying cigarettes of N times unit length (N is a whole number including one). For example, the removing means can include a first receptacle (such as a flute) having means for repeatedly removing pairs of coaxial cigarettes from the first path and a second receptacle having means for repeatedly removing pairs of coaxial cigarettes from the second path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF THE PREFERRED EMBODIMENTS

Figure 1:
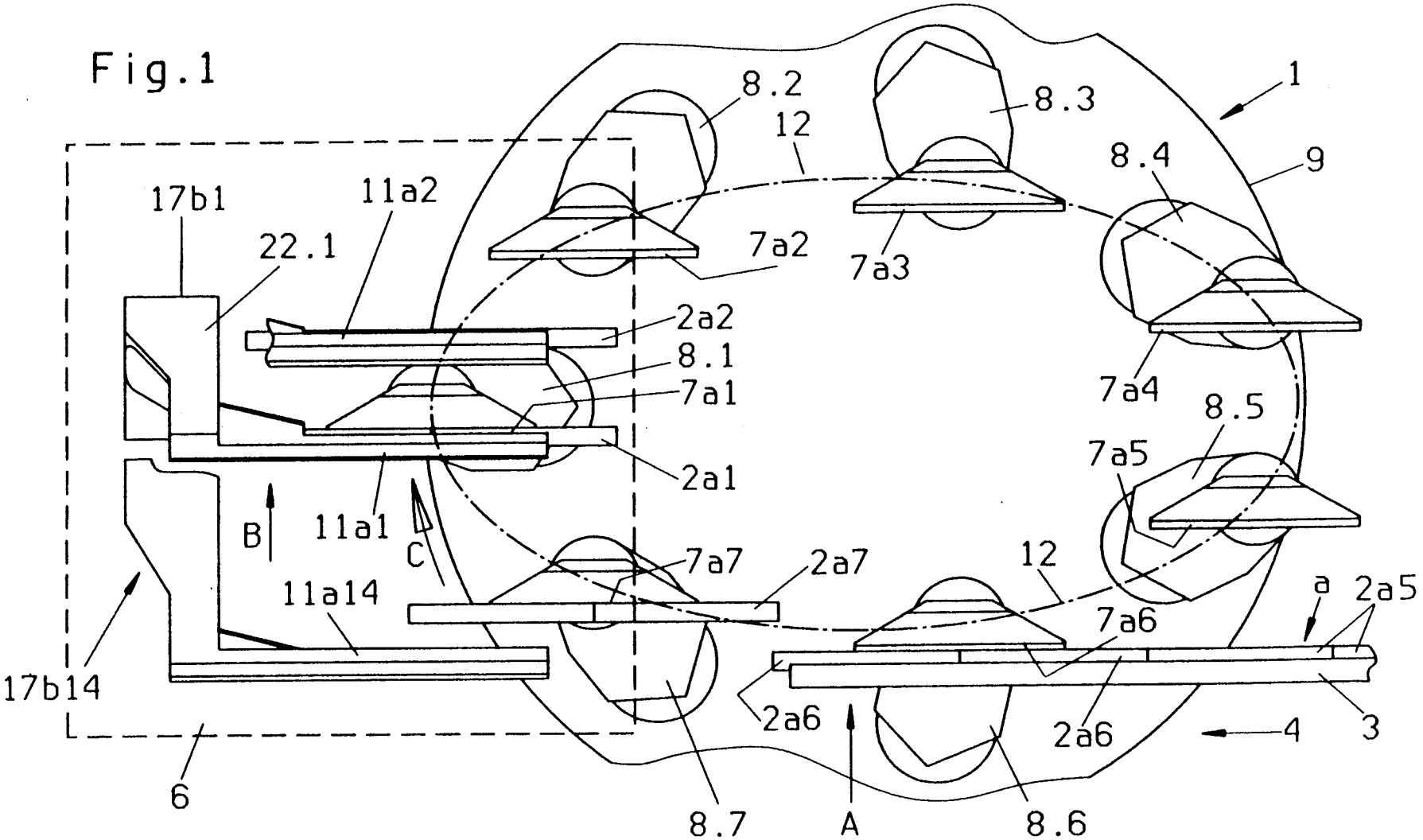
FIG. 1 is a schematic front elevational view of the first conveyor, a fragmentary schematic side elevational view of the article supplying means, and a schematic side elevational view of the second conveyor in an apparatus which embodies one form of the present invention.
Figure 2:
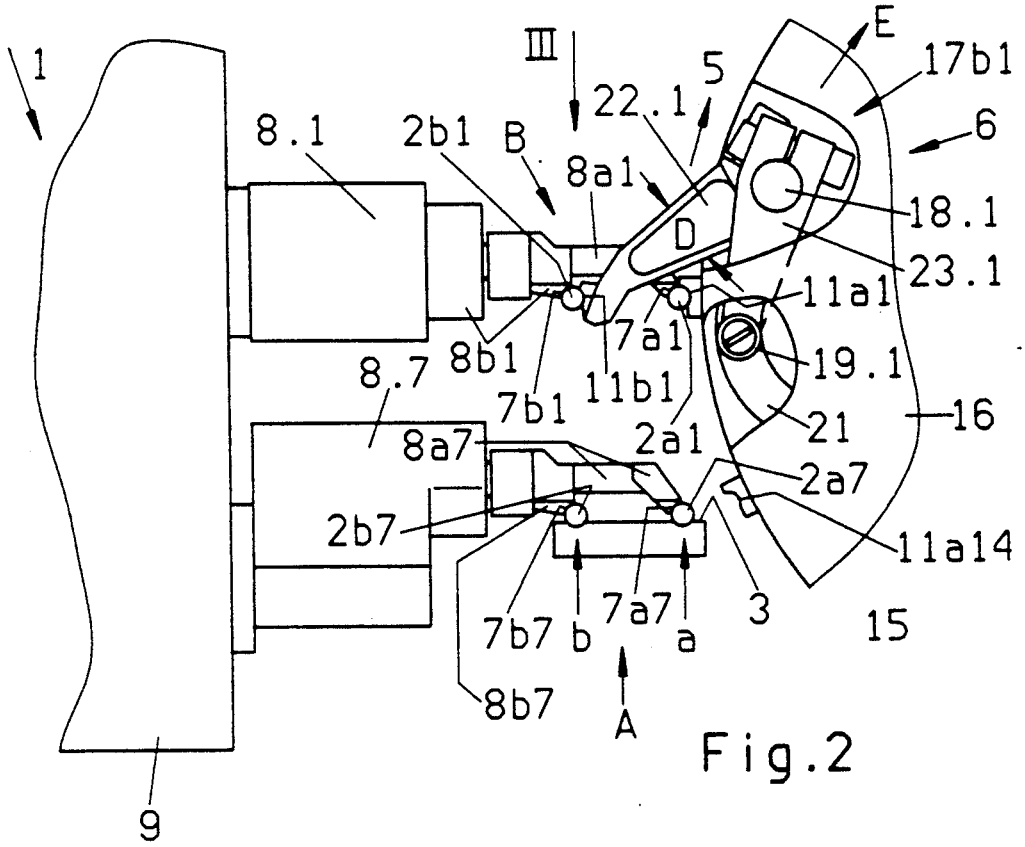
FIG. 2 is a fragmentary side elevational view of the first conveyor and a fragmentary schematic front elevational view of the second conveyor as well as an end elevational view of the article supplying means in the apparatus of FIG. 1.
Figure 3:
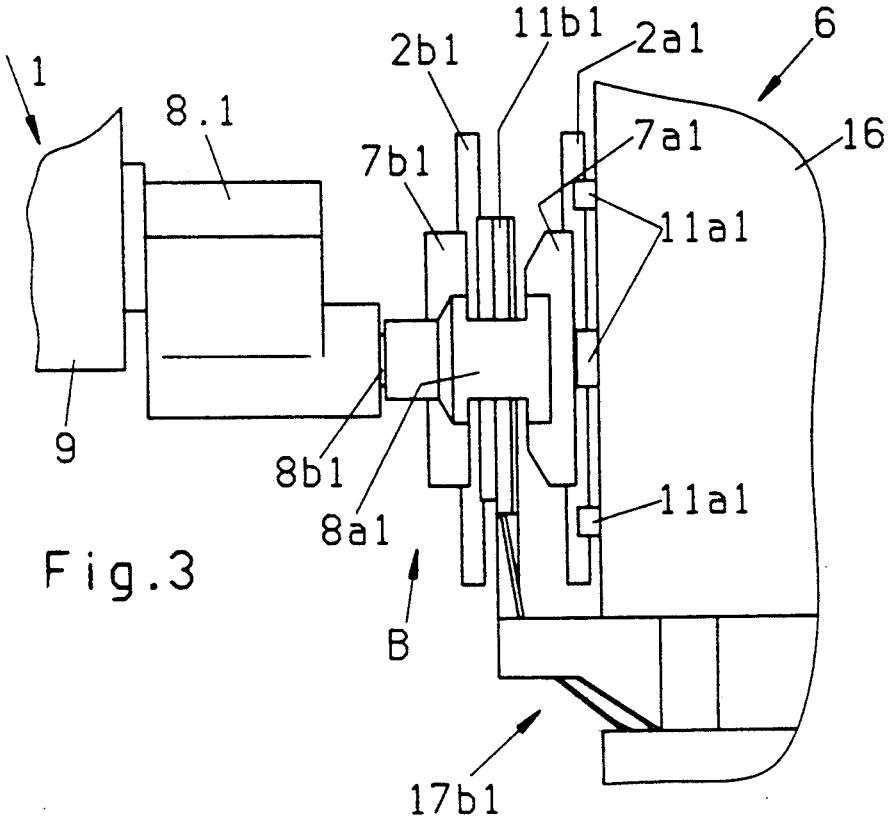
FIG. 3 is a plan view as seen in the direction of arrow III in FIG. 2.
Figure 9:
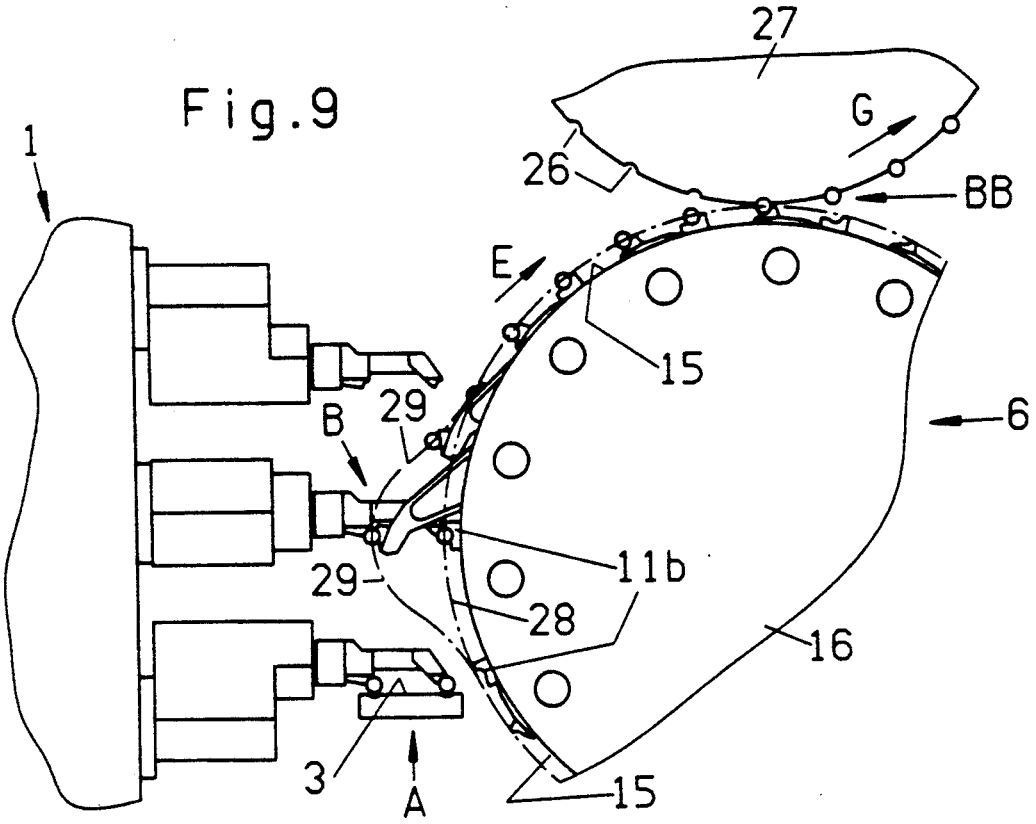
FIG. 9 is a smaller-scale view of the structure which is shown in FIG. 2 and a fragmentary end elevational view of a third conveyor which receives a row of parallel articles from the second conveyor.

The apparatus which is shown in FIGS. 1 to 3 comprises a horizontal guide rail 3 serving as a means for supplying two parallel files of coaxial rod-shaped articles 2*a* and 2*b* of unit length or multiple unit length. The upper side of the guide rail 3 has two parallel elongated channels which respectively define first and second paths a and b for the files of articles 2*a* and 2*b*, respectively. The direction of advancement of articles 2*a*, 2*b* along the respective first and second paths is indicted by arrow 4. For example, the articles 2*a* can constitute successive plain cigarettes of unit length which are obtained as a result of repeated severing of a first continuous cigarette rod which is turned out by a twin or dual cigarette making machine of the type disclosed in numerous patents of the assignee of the present application and known as PROTOS 2. Reference may be had, for example, to commonly owned U.S. Pat. No. 5,125,419 granted Jun. 30, 1992 to Heitmann. The articles 2*b* then constitute successive plain cigarettes of unit length which are obtained as a result of repeated severing of a second continuous cigarette rod which is turned out by the same twin or dual cigarette rod making machine. The articles 2*a*, 2*b* are advanced at a predetermined speed which can be imparted thereto by customary accelerators downstream of the cutoffs for the respective cigarette rods. However, it is equally possible to use the improved apparatus for the manipulation of plain cigarettes of multiple unit length which are thereupon severed to yield plain cigarettes of unit length. For example, if the articles 2*a*, 2*b* are plain cigarettes of double unit length, they can be severed midway between their axial ends by a suitable rotary knife (not shown) in a filter tipping machine which receives plain cigarettes of double unit length from the last conveyor (note the conveyor 27 in FIG. 9) of the improved apparatus. Still further, the apparatus of the present invention can be utilized to manipulate filter cigarettes of unit length or multiple unit length as well as plain or filter tipped cigars, cigarillos or cheroots of unit length or multiple unit length, or filter rod sections of unit length or multiple unit length. For the sake of simplicity, the articles 2*a* and 2*b* will be called cigarettes, and it will be assumed that such cigarettes are of unit length.

The apparatus of FIGS. 1 to 3 further comprises a first rotary conveyor 1 having seven equidistant article circulating or orbiting devices 8.1 to 8.7 in the form of arms having pairs of end portions 8*a*1 to 8*a*7 and 8*b*1 to 8*b*7 (only a few of these end portions are actually shown in the drawing) which respectively comprise removing means in the form of receptacles or flutes 7*a*1 to 7*a*7 for successive cigarettes 2*a*1 to 2*a*7 and removing means in the form of receptacles or flutes 7*b*1 to 7*b*7 (only a few shown) for successive cigarettes 2*b*1 to 2*b*7. The transfer station between the guide channel 3 and the first rotary conveyor 1 is shown at A, and the removing means or receptacles (hereinafter called flutes) 7*a*1–7*a*7 and 7*b*1–7*b*7 serve to transport cigarettes 2*a* and 2*b* from the station A to a station B where the cigarettes are accepted by accepting devices or flutes 11*a*1 to 11*a*14 and accepting means or flutes 11*b*1 to 11*b*14 of a second rotary conveyor 6. The arms 8.1 to 8.7 receive motion from a transmission in a casing 9 of the first conveyor 1, and the purpose of such transmission is to ensure that the orientation of the cigarettes 2*a* and 2*b* remains unchanged during removal from the paths a and b at the station A as well as during transport from the station A to the station B. The cigarettes 2*a*, 2*b* move axially in the channels of the guide rail 3, they move in part axially and in part sideways (i.e., transversely of their longitudinal axes) during movement from the station A to the station B, and they move sideways upon engagement by the accepting flutes 11*a*1–11*a*14 and 11*b*1–11*b*14 of the second conveyor 6. The direction of axial movement of the cigarettes 2*a*, 2*b* is indicated by the arrow 4, and the direction of sidewise movement of the cigarettes is indicated by the arrow 5.

FIG. 1 merely shows a pair of coaxial cigarettes 2*a*6, and a pair of coaxial cigarettes 2*a*5 behind the cigarettes 2*a*6, both pairs in the path a, a pair of cigarettes 2*a*7 carried by the flute 7*a*7 on the arm 8.7, a pair of cigarettes 2*a*1 at the station B (in process of being released by the flutes 7*a*1), and a pair of cigarettes 2*a*2 in the flute 11*a*2 of the conveyor 6. The cigarettes 2*b* are concealed behind the cigarettes 2*a*. Each of the flutes 7*a*1–7*a*7 and 7*b*1–7*b*7 is designed to accept two coaxial cigarettes 2*a*, 2*b*, respectively, the same as each of the flutes 11*a*1–11*a*14 and 11*b*1–11*b*14. The flutes 7*a*6 and 7*b*6 on the arm 8.6 at the transfer station A simultaneously remove from the guide rail 3 a pair of coaxial cigarettes 2*a*6 and a pair of coaxial cigarettes 2*b*6, and such pairs of cigarettes are thereafter accepted by the flutes 11*a*13 and 11*b*13 at the transfer station B. The pairs of cigarettes 2*a*7 and 2*b*7 are in the process of being advanced (by the flutes 7*a*7 and 7*b*7) from the station A toward the station B to be accepted by the flutes 11*a*14 and 11*b*14, and (as already mentioned above) the flutes 11*a*1, 11*b*1 at the station B are in the process of accepting pairs of cigarettes 2a1, 2b1 from the flutes 7a1, 7b1.

A transmission which can control the arms 8.1 to 8.7 of the conveyor 1 in such a way that the orientation of the removing flutes 7a1–7a7 and 7b1–7b7 remains unchanged (i.e., that such flutes remain parallel to the paths a and b) is disclosed, for example, in commonly owned U.S. Pat. No. 4,051,947 granted Oct. 4, 1977 to Schumacher et al. The disclosure of this patent (as well as of each other patent mentioned in this specification) is incorporated herein by reference. A similar transmission (which can be incorporated in the housing or casing 9 of the conveyor 1) is disclosed in commonly owned British Pat. No. A-2217574. The difference between the transmission of the British patent and the transmission which can be used in the conveyor 1 of the present invention is that the conveyor 1 has arms 8.1 to 8.7 each of which can simultaneously remove and transport two pairs of cigarettes 2a as well as two pairs of cigarettes 2b. The flutes 7a1–7a7 and 7b1–7b7 can be provided in separately produced channel-like parts which are affixed to the respective end portions 8a1–8a7 and 8b1–8b7 of the corresponding arms 8.1–8.7.

The means for attracting cigarettes 2a and 2b to the respective flutes 7a1–7a7 and 7b1–7b7 includes suction generating devices with suction ports in the flutes. Such suction generating devices are effective during advancement of flutes 7a and 7b between the stations A and B, and the (analogous) suction generating means for attracting cigarettes 2a and 2b to the flutes 11a and 11b of the conveyor 6 are operative between the station B and a transfer station BB between the conveyors 6 and 27. Suitable suction generating means are disclosed in the aforementioned commonly owned British Pat. No. A-2217574 as well as in the aforementioned commonly owned U.S. Pat. No. 4,051,947.

The elliptical (third) path which is defined by the arms 8.1–8.7 of the conveyor 1 is shown at 12; the major axis of this elliptical path is parallel with the cigarettes 2a and 2b in the flutes 7a, 7b and in the channels of the guide rail 3, and the minor axis intersects the elliptical path at the transfer station A. This means that, while moving from the station A toward the station B, the speed of cigarettes 2a and 2b decreases (to zero) in the direction of arrow 4 but increases (from zero) in the direction of arrow 5, i.e., in the direction of movement of flutes 11a and 11b of the second conveyor 6. The speed of the flutes 7a and 7b at the station A preferably equals or even slightly exceeds the speed of the cigarettes 2a and 2b on the guide rail 3 (in order to avoid collision between the pairs of cigarettes which are carried by the flutes 7a and 7b away from the station A and the cigarettes 2a and 2b which are in the process of arriving at the station A).

The path 12 is assumed to be located in a vertical plane at a level above the paths a and b for the cigarettes 2a and 2b on the guide rail 3. Thus, the flutes 7a, 7b must descend toward the station A and must rise on their way toward the station B. The direction of advancement of pairs of cigarettes 2a and 2b from the station A toward the station B is indicated by an arrow C.

FIG. 2 illustrates the transfer of two pairs of coaxial cigarettes 2a1 and 2b1 from the flutes 7a1, 7b1 on the end portions 7a1, 7b1 on the end portions 8a1, 8b1 of the arm 8.1 forming part of the conveyor 1 into the flutes 11a1, 11b1 of the conveyor 6. FIG. 2 further shows the flutes 7a7 and 7b7 (which carry pairs of cigarettes 2a7 and 2b7) on their way from the station A, in the direction of arrow C, and on toward the transfer station B. As already explained hereinbove, the mode of transporting cigarettes 2a and 2b from the station A to the station B is such that the orientation of the cigarettes remains unchanged, that their speed in the direction of arrow 4 is on the decrease to zero, and that their speed in the direction of arrow 5 is on the increase from zero to a maximum speed corresponding to that of the flutes 11a and 11b on the conveyor 6.

The conveyor 6 defines an endless circular (fourth) path extending along the peripheral surface 15 of a rotary drum-shaped support or rotor 16 of this conveyor. The flutes 11a1 to 11a14 are fixed on the rotor 16, i.e., they do not perform any movements relative to the rotor. However, the flutes 11b1 to 11b14 are mounted on discrete moving means 17b1 to 17b14 each of which can move the respective flute first in a direction from the fourth path (15) toward the third path (12) to accept a pair of cigarettes 2b from the oncoming flute 7b1 or 7b2 or 7b3 or 7b4 or 7b5 or 7b6 or 7b7, and to thereupon move with the thus accepted pair of cigarettes 2b back toward the fourth path (15). When the transfer of a pair of cigarettes 2b onto the conveyor 6 (i.e., all the way to the peripheral surface 15) is completed, the cigarettes 2b of such pair are disposed midway between two pairs of cigarettes 2a in the respective flutes 11a. This can be readily seen in FIG. 9. The flutes 11a1 to 11a14 are preferably equidistant from each other.

The moving means 17b1 to 17b14 for the flutes 11b1 to 11b14 comprise levers 22.1 to 22.14 and 23.1 to 23.14. The levers 23.1 to 23.14 are pivotably mounted on the rotor 16 of the conveyor 6 (as at 18.1 to 18.14). The levers 22.1 to 22.14 carry roller followers 19.1 to 19.14 extending into the suitably configurated endless groove of a cam 21. This cam cooperates with roller followers 19.1 to 19.14 to pivot the respective levers 22.1 to 22.14 in response to rotation of the rotor 16 of the conveyor 6 in the direction of arrow E. The pivot axes of the levers 22.1 to 22.14 and 23.1 to 23.14 are parallel to the axis of rotation of the rotor 16 and to the axes of cigarettes 2a and 2b on the guide rail 3. The directions of back-and-forth pivotal movements of levers 22.1 to 22.14 about the axes of the respective shafts 18.1 to 18.14 are indicated in FIG. 2, as at D. The suction ports of the flutes 11a1 to 11a14 are connected to a suitable suction generating device during advancement of such flutes between the transfer stations B and BB, and the suction ports of the flutes 11b1 to 11b14 (which pivot with the respective levers 22.1 to 22.14) are also connected to a suction generating device during advancement from the station B to the station BB. This ensures reliable retention of pairs of cigarettes 2a and 2b in the respective flutes 11a and 11b even if the rotor 16 of the conveyor 6 is driven at an elevated speed such as is necessary to transfer large numbers of cigarettes between a twin maker and a modern filter tipping machine (e.g., a machine known as MAX distributed by the assignee of the present application).

The levers 22.1–22.14 are angularly adjustable relative to the corresponding levers 23.1–23.14 to thus change the two end positions of the respective flutes 11b1–11b14, if and when necessary.

FIG. 2 shows the lever 22.1 in an extended position in which the respective flute 11b1 is located at a maximum distance from the peripheral surface 15 (fourth path) and is in the process of receiving two coaxial cigarettes 2b1.

Figure 4:
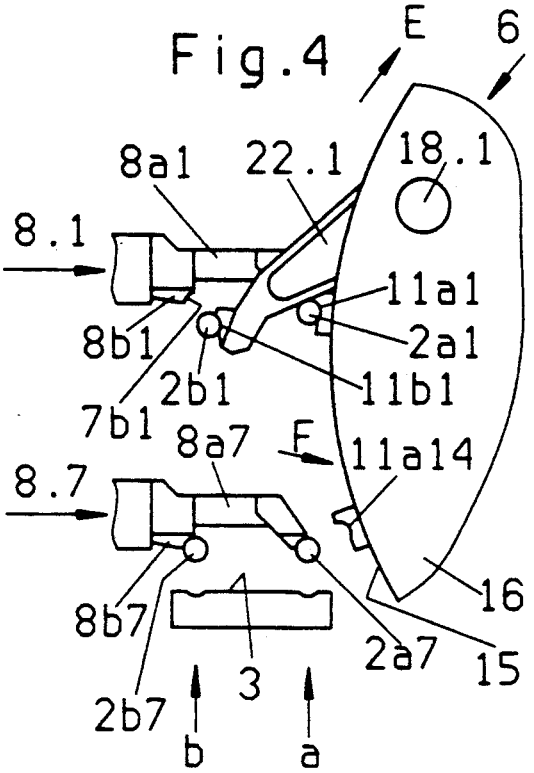
FIGS. 4 to 8 are smaller-scale views of a portion of the structure of FIG. 2 and illustrate various stages of transfer of rod-shaped articles between the first and second conveyors.
Figure 5:
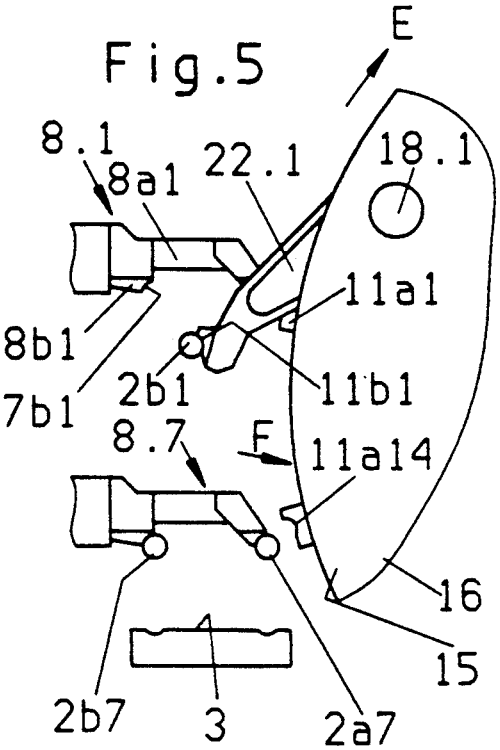
Figure 6:
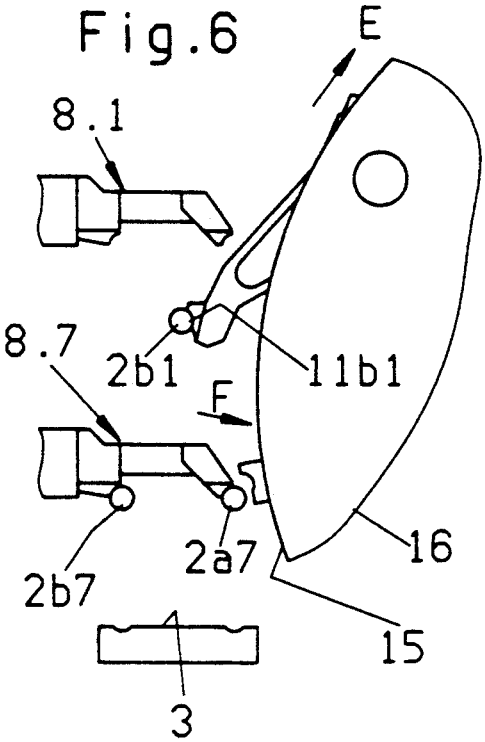
Figure 7:
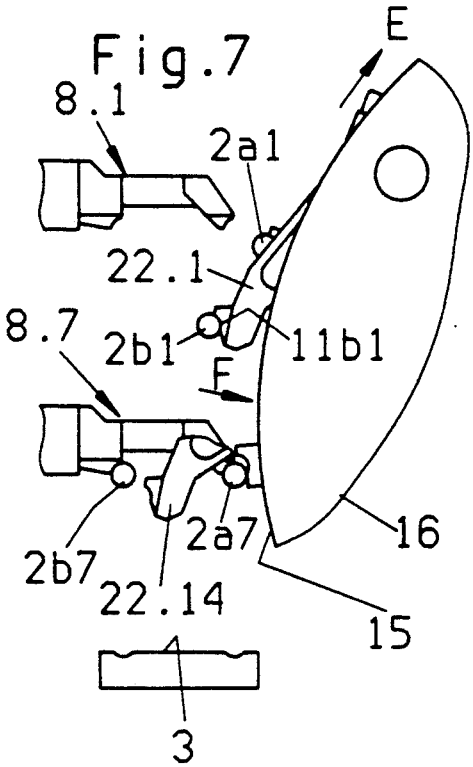

FIG. 4 shows the structure of FIG. 2 subsequent to an angular displacement of the rotor 16 in the direction of arrow E through approximately 10°. The lever 22.1 of the moving means 17b1 for the flute 11b1 has moved the flute 11b1 and the pair of coaxial cigarettes 2b1 therein away from the flute 7b1 in response to tracking of a portion of the cam 21 by the roller follower 19.1. The suction port or ports in the flute 7b1 were disconnected from the suction generating device in the angular positions of the conveyors 1 and 6 as shown in FIG. 2 or shortly thereafter, and the suction port or ports of the flutes 11b1 were connected to the suction generating device not later than in the position of FIG. 2 so that the cigarettes 2b1 are readily separated from the flute 7b1 and are readily entrained by the flute 11b1. The direction in which the flute 11b1 moves toward the peripheral surface 15 of the rotor 16 during angular movement of the conveyor 6 from the position of FIG. 2 to the position of FIG. 4 is indicted by arrow F.

Figure 8:
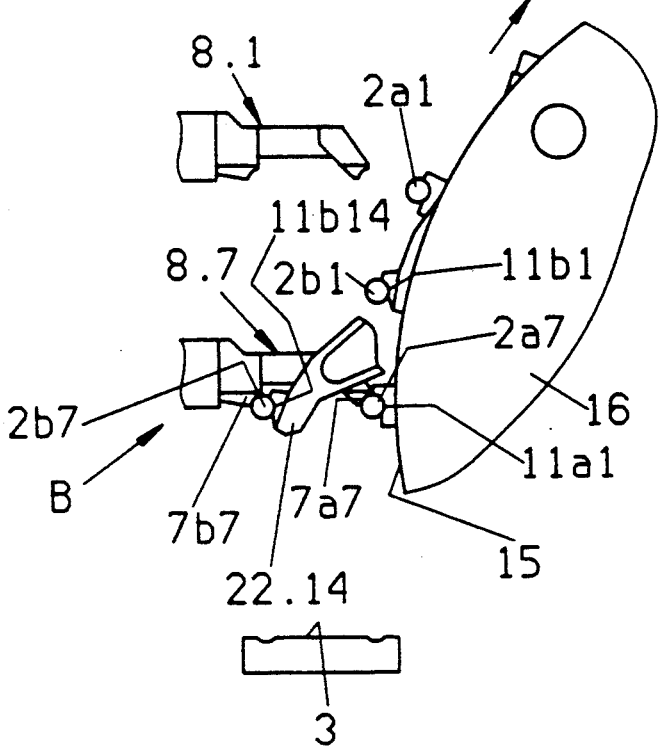

FIGS. 5 through 8 illustrate further stages of movement of the conveyor 6 in the direction of arrow E with continued pivoting of the lever 22.1 in the direction of arrow F, i.e., with continuing movement of the flute 11b1 and the cigarettes 2b therein from the conveyor 1 toward the peripheral surface 15 of the conveyor 6. Pivoting of the lever 22.1 all the way to its fully retracted position is completed when the conveyor 6 reaches the angular position of FIG. 8. At such time, the next-following lever 22.14 maintains its flute 11b14 in a position for acceptance of two cigarettes 2b7 from the flute 7b7 on the end portion 8b7 of the arm 8.7 on the conveyor 1. The cigarettes 2b7 and 2a7 of FIG. 8 are located at the transfer station B and are disposed at a certain level above the horizontal paths a and b which are defined by the guide rail 3. The cigarettes 2a7 which are shown in FIG. 8 are accepted directly by the flute 11a1 at the peripheral surface 15 of the conveyor 6, and the lever 22.14 thereupon begins to pivot in order to move the cigarettes 2b7 from the flute 7b7 of the arm 8.7 toward the peripheral surface 15 of the conveyor 6, the same as shown in FIGS. 2 and 4–8 for the lever 22.1 and cigarettes 2b1.

The flutes 11a and 11b which advance beyond the transfer station B and approach the transfer station BB ultimately carry alternating pairs of coaxial cigarettes 2a and 2b, and such pairs of cigarettes are preferably equidistant from each other and are caused to move sideways to enter successive receiving means or flutes 26 of the third rotary conveyor 27. Thus, the conveyors 1, 6 and 27 cooperate with the supplying means or rail 3 to convert two parallel files of coaxial cigarettes 2a and 2b which move axially into a single row of alternating pairs of cigarettes 2a and 2b which move sideways and are preferably equidistant from each other (as seen in the circumferential direction of the conveyor 27). Thus, paths a and b are side by side paths in the horizontal plane of rail 3, and elliptical path 12 of conveyor 1 is disposed in a vertical plane at right angles (perpendicular) to such horizontal plane of rail 3. In turn, conveyor 6 can be arranged with its peripheral path 15 disposed in a vertical plane at right angles to the vertical plane of elliptical path 12 of conveyor 1, and such that conveyor 6 is parallel to conveyor 27.

The conveyor 27 is driven to advance the pairs of cigarettes 2a and 2b in the direction of arrow G, e.g., into or in a filter tipping machine. The phantom-line circle 28 denotes in FIG. 9 the path of the axes of pairs of cigarettes 2a and the path of the axes of cigarettes 2b upon completion of pivoting of the respective levers 22 in the direction of arrow F. The phantom-line curve 29 indicates the path of a flute 11b from the peripheral surface 15 of the rotor 16, to the transfer station B and back to the peripheral surface 15. When the pivoting of a lever 22 is completed, the respective flute 11b comes to rest at the peripheral surface 15 midway between the neighboring flutes 11a.

The improved apparatus can be modified in a number of ways without departing from the spirit of the invention. For example, each of the flutes 7a, 7b, 11a, 11b can be designed to carry a single cigarette or three or even more cigarettes. Furthermore, the number of flutes on the conveyor 11 can be increased or reduced, the same as the number of flutes on the conveyor 6. For example, the conveyor 1 can carry a single flute 7a and a single flute 7b, and the conveyor 6 can carry two flutes 11a and two flutes 11b.

An important advantage of the improved apparatus is its simplicity. Thus, it is not necessary to employ complex electronic or other controls because all pivotal movements of the levers 222 can be initiated by simple cam and follower combinations. Furthermore, the wear is negligible because a large number of flutes need not perform any movements relative to the respective conveyors. A further important advantage of the improved apparatus is its compactness. Thus, the path 12 can be disposed in a vertical plane above the preferably horizontal paths a and b, and the conveyor 6 can be placed into close proximity to the conveyor 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for transporting rod-shaped articles of the tobacco processing industry, comprising means for supplying first and second files of coaxial articles along parallel first and second paths located in a substantially horizontal plane; a first conveyor having at least one circulating device including means for removing articles from said files and for conveying the removed articles along a third path located in a substantially vertical plane substantially at right angles to said horizontal plane; and a second conveyor having means for accepting the articles from said removing means and for moving the accepted articles sideways along a fourth path, said second conveyor further having means for moving said accepting means from said fourth path toward said third path to accept articles from said removing means and thereupon back to said fourth path.

2. The apparatus of claim 1, wherein said second conveyor comprises a rotary drum-shaped support for said accepting means and said moving means.

3. The apparatus of claim 1, wherein said second conveyor comprises a rotor having a peripheral surface which defines said fourth path.

4. The apparatus of claim 3, wherein said second conveyor further comprises at least one article accepting device at said peripheral surface and said removing means includes a first receptacle for articles of said first file and a second receptacle for articles of said second file, said accepting device including means for receiving articles of said first file from said first receptacle, said accepting means including means for receiving articles of the second file from said second receptacle.

5. The apparatus of claim 4, wherein said first conveyor comprises a plurality of circulating devices each having discrete removing means with first and second receptacles, said second conveyor comprising a plurality of accepting devices for articles of said first file, discrete accepting means for each accepting device, and discrete moving means for each of said accepting means.

6. The apparatus of claim 5, wherein each of said moving means comprises a lever.

7. The apparatus of claim 5, wherein each of said moving means comprises a pivotable lever provided on said rotor and having a follower, and a cam which is tracked by the followers of said levers.

8. The apparatus of claim 7, wherein said rotor is rotatable about a first axis and said levers are pivotable about second axes parallel to said first axis.

9. The apparatus of claim 8, wherein said accepting devices are parallel to said axes.

10. The apparatus of claim 5, wherein said accepting devices are equidistant from each other in the circumferential direction of said rotor.

11. The apparatus of claim 10, wherein said accepting means are equidistant from each other and from said accepting devices upon movement of said accepting means back to said fourth path.

12. The apparatus of claim 1, further comprising a third conveyor having means for receiving articles from said second conveyor.

13. The apparatus of claim 1, wherein said first conveyor further comprises means for maintaining said article removing means in parallelism with the articles in said first and second paths.

14. The apparatus of claim 13, wherein said third path is disposed at a level above said first and second paths.

15. The apparatus of claim 13, wherein said third path is an elliptical path having a major axis parallel to said first and second paths and a minor axis, said supplying means including means for advancing articles along said first and second paths at a first speed and said third path being positioned to enable said removing means to remove articles from said first and second paths at said minor axis and substantially at said first speed and to reduce the speed of removed articles to a second speed during movement along the third path toward a transfer station between said third and fourth paths, said transfer station being disposed at said major axis.

16. The apparatus of claim 1, wherein said supplying means includes means for supplying cigarettes of N times unit length wherein N is a whole number including one.

17. The apparatus of claim 16, wherein said removing means includes a first receptacle having means for repeatedly removing pairs of coaxial cigarettes from said first path and a second receptacle having means for repeatedly removing pairs of coaxial cigarettes from said second path.

18. Apparatus for transporting rod-shaped articles of the tobacco processing industry, comprising means for supplying first and second files of coaxial articles along parallel first and second paths located in substantially horizontal side by side relation in a substantially horizontal plane, a first conveyor having at least one circulating device including means for removing a set of adjacent first and second file articles in said side by side relation from said files and for conveying the removed set of first and second file articles in said side by side relation along a third path located in a substantially vertical plane substantially at right angles to said horizontal plane, and a second conveyor having means for accepting the set of said articles in said side by side relation in said third path from said removing means, the accepting means including a first acceptor for accepting a first file article of a said set and a second acceptor for accepting a second file article of a said set, and means for moving the accepted set of articles sidewise along a fourth path such that a first file article and a second file article move in sidewise successive relation therealong, said first acceptor being located in said fourth path adjacent said third path and said second acceptor being normally located in said fourth path spaced from said third path, said second conveyor further having means for moving said second acceptor from said fourth path toward said third path to accept articles from said removing means and thereupon back to said fourth path.

19. Apparatus of claim 18 further comprising a third conveyor having means for receiving said first and second file articles in corresponding sidewise successive relation from said second conveyor.

* * * * *